US005380162A

United States Patent [19]

Evans, II et al.

[11] Patent Number: 5,380,162

[45] Date of Patent: Jan. 10, 1995

[54] SPLIT DRIVESHAFT PUMP FOR HAZARDOUS FLUIDS

[75] Inventors: Thomas P. Evans, II, Aiken, S.C.; Jwalit J. Purohit, Evans, Ga.; John M. Fazio, Orchard Park, N.Y.

[73] Assignee: The United States of America as represented by the United States Department of Energy, Washington, D.C.

[21] Appl. No.: 75,900

[22] Filed: Jun. 11, 1993

[51] Int. Cl.[6] ..... F04B 49/00

[52] U.S. Cl. ..... 417/223; 417/423.11; 417/423.14

[58] Field of Search ..... 417/223, 423.1, 423.11, 417/423.14, 423.15, 423.3, 424.1; 415/216.1

[56] References Cited

U.S. PATENT DOCUMENTS

| | | | |
|---|---|---|---|
| 2,839,006 | 6/1958 | Mayo | 417/424.1 |
| 2,930,325 | 3/1960 | Beard et al. | 417/423.15 |
| 2,978,988 | 4/1961 | McAlpine | 417/423.14 |
| 3,163,117 | 12/1964 | Haentijens | 417/424.1 X |
| 3,179,827 | 4/1965 | Baker | 417/424.1 X |
| 3,519,365 | 7/1970 | Conhagen | 417/423.14 |
| 3,737,255 | 6/1973 | Emeny | 417/424.1 |
| 3,771,926 | 11/1973 | Pardieck | 417/423.11 X |
| 3,782,860 | 1/1974 | DeLancey et al. | 417/424.1 X |
| 3,897,176 | 7/1975 | Emeny | 417/423.11 |
| 3,936,221 | 2/1976 | Lobanoff | 417/424.1 X |
| 4,098,557 | 7/1978 | Claunch et al. | 417/423.11 |
| 4,523,900 | 6/1985 | Frey | 417/423.14 |
| 4,669,956 | 6/1987 | Brunel et al. | 417/423.14 |
| 4,854,828 | 8/1989 | Haentjens | 417/424.1 X |
| 4,875,836 | 10/1989 | Zehnder et al. | 417/424.1 X |
| 5,076,762 | 12/1991 | Lykes et al. | 417/424.1 X |
| 5,096,391 | 3/1992 | Tuckey | 417/423.14 |

FOREIGN PATENT DOCUMENTS

| | | | |
|---|---|---|---|
| 2508983 | 1/1983 | France | 417/423.11 |
| 372952 | 5/1932 | United Kingdom | 417/423.11 |

*Primary Examiner*—Richard A. Bertsch
*Assistant Examiner*—Peter Korytnyk
*Attorney, Agent, or Firm*—Brian R. Tumm; Harold M. Dixon; William R. Moser

[57] ABSTRACT

A pump having a split driveshaft for use in pumping hazardous fluids wherein only one driveshaft becomes contaminated by the fluid while the second remains isolated from the fluid. The pump has a first portion and a second portion. The first portion contains a pump motor, the first driveshaft, a support pedestal, and vapor barriers and seals. The second portion contains a second, self-lubricating driveshaft and an impeller. The first and second driveshafts are connected together by a releasable coupling. A shield and a slinger deployed below the coupling prevent fluid from the second portion from reaching the first portion. In operation, only the second assembly comes into contact with the fluid being pumped, so the risk of contamination of the first portion by the hazardous fluid is reduced. The first assembly can be removed for repairs or routine maintenance by decoupling the first and second driveshafts and disconnecting the motor from the casing.

20 Claims, 1 Drawing Sheet

SPLIT DRIVESHAFT PUMP FOR HAZARDOUS FLUIDS

BACKGROUND OF THE INVENTION

1. Field of the Invention

The present invention relates to pumps for pumping hazardous fluids. In particular, the present invention relates to a pump having a split driveshaft consisting of two coaxial shafts connected by a releasable coupling. The United States Government has rights in this invention pursuant to Contract No. DE-AC09-89SR 18035 between the U.S. Department of Energy and Westinghouse Savannah River Company.

2. Discussion of Background

Pumps are widely used in industry to handle liquids and slurries. Many times these liquids and slurries contain radioactive or hazardous materials, including toxic, explosive, or combustible materials, or mixed radioactive and hazardous materials. Presently-available pumps are single shaft designs, that is, an impeller is operatively connected to the pump motor via a single, unitary driveshaft. These designs increase the difficulty in performing maintenance on the pump motor and other sections of the pump because single shafts are typically self-lubricating, that is, the fluid being pumped serves as the lubrication fluid for the shaft bearings, it inevitably contaminates much of the pump. Even for designs that use grease-lubricated bearings, the possibility of the spread of contamination exists.

To limit personnel exposure to hazardous materials, some pumps are designed to be serviced by remotely controlled manipulators or robots, often requiring modification of designs to accommodate remote servicing limitations. If the pump is to be serviced manually, it must first be removed from the installation and decontaminated. Whether done remotely or manually following decontamination, cleaning and servicing contaminated equipment is time-consuming and very costly. Downtime, higher labor cost, and the possibility of personnel exposure to hazardous materials, all contribute to cost. In the case of equipment used in nuclear facilities, the radiation exposure in removing the contaminated equipment can be high, and radiation exposure standards limit the amount of time workers can spend in a radioactive environment.

A number of methods are available for coupling a motor shaft and a pump driveshaft (Haentjens, U.S. Pat. No. 4,854,828; Mayo, U.S. Pat. No. 2,839,006; Pardieck, U.S. Pat. No. 3,771,926), but these are designed to transfer not only torsional forces but axial forces as well and are therefore somewhat complex and more difficult to remove for servicing. Slingers (Haentjens, U.S. Pat. No. 3,163,117; Mayo, U.S. Pat. No. 2,839,006) and cover plates (Pardieck, U.S. Pat. No. 3,771,926) are used to help seal or isolate the pumped fluid from the upper portion of the pump assembly. Pump constructions may prevent the escape of pumped fluids (Zehnder, et al., U.S. Pat. No. 4,875,836), and allow quick removal and replacement of the pump's motor (Baker, U.S. Pat. No. 3,179,827). However, there are no pumps currently available that are designed to minimize contamination of the high-maintenance portions of the pump, and to minimize personnel exposure to hazardous constituents of the fluid during operation and maintenance.

SUMMARY OF THE INVENTION

According to its major aspects and broadly stated, the present invention is a pump having a first assembly and a second assembly installed in a common outer casing. The first portion of the pump contains the first assembly, including the pump motor, a first driveshaft extending through a support pedestal, and vapor barriers and seals. The second portion contains the second assembly, including a second, self-lubricating driveshaft and an impeller. The first and second driveshafts are operatively connected to each other via a slip coupling. A spray shield and a shaft slinger deployed about the second shaft, adjacent to the coupling, prevent fluid from reaching the upper portion of the pump. The pump is made of any durable materials that are suitable for use in the intended environment.

The pump is installed for use with the outer casing partially immersed into the fluid, preferably such that the highest fluid level outside the pump is no higher than the spray shield. In operation, the first portion of the pump is isolated from contact with the second portion, since there is no flow path of the pumped fluid from the second portion to the first portion. Only the second portion comes into contact with the fluid being pumped, so the risk of contamination of the first portion by any hazardous constituents of the fluid is reduced. Once installed, the pump may remain in position indefinitely with all or part of the second portion immersed in the fluid to be pumped. The first assembly with the motor—the component most likely to require maintenance—can be easily removed for repairs or routine maintenance, simply by decoupling the first and second driveshafts and disconnecting the motor from the casing. Because the risk of contamination of the first assembly is reduced, the pump can be serviced expeditiously, without having personnel exposed to hazardous constituents of the fluid, and, where the pump is used to transfer radioactive fluids, with little or no radiation exposure.

An important feature of the present invention is the slip coupling. The coupling, preferably a blind slip coupling, holds the first and second driveshafts in coaxial alignment so that torque is transmitted from the first shaft to the second shaft. Since the coupling can be removed by simply slipping it off the shaft, the first assembly—with the first driveshaft—can be decoupled from the second assembly and removed for repairs or maintenance as needed very quickly and easily, an important consideration when personnel exposure to hazardous or radioactive materials is likely.

The combination of the slinger, the shield and the vapor barrier constitutes another feature of the present invention. The slinger, attached to the second driveshaft, below the spray shield, picks up liquid moving along the second shaft and directs it radially outwardly, toward the outer casing and through a plurality of openings in the outer casing. The shield, deployed about the second driveshaft adjacent to the releasable coupling, acts as a barrier to movement of the fluid toward the releasable coupling from the second portion. Together, the slinger and shield reduce the risk of contamination of the first assembly by substantially preventing liquids from the second portion from passing into the first portion. A vapor barrier is deployed about the first driveshaft adjacent to the coupling, and, if desired, a vapor seal is positioned at the opposing end of the first shaft. The vapor barrier, the slinger and the shield effectively isolate the first portion of the pump from the second portion, reducing the risk of contamination of the first assembly by the fluid being pumped.

Another feature of the present invention is the first assembly. The first assembly includes a motor of any type adapted for use in the environment of the pump, the first driveshaft and a support pedestal. The motor driveshaft is connected to the first driveshaft by a coupling of any suitable design that is capable of maintaining the two shafts in alignment and transmitting torque generated by the motor to the first shaft. By way of example, the coupling may include rigid flanges on the motor shaft and the first driveshaft, bolted together to form a continuous shaft. Alternatively, a flexible coupling may be used to reduce the effects of misalignment and torque variations. The support carries a plurality of ball bearing retainers, each retainer holding a ball bearing for rotatably supporting and aligning the first driveshaft with the motor driveshaft. The bearings are any suitable type of bearings known in the art, such as grease lubricated ball bearings.

Still another feature of the present invention is the second assembly. The second assembly includes the second driveshaft, the impeller, and an inner casing maintained in spaced relation to the outer casing by a plurality of retainers. The inner casing has an open first end, and a second end attached to the outer casing. The inner casing carries a plurality of radial shaft bearings, preferably pumped fluid lubricated bearings, that rotatably support and align the second driveshaft in spaced relation to the inner casing. If desired, a strainer is attached to the impeller casing for filtering solids from the fluid.

The second driveshaft is self-lubricating, that is, the shaft is lubricated by fluid pumped along the shaft by the impeller. During operation of the pump, a portion of the fluid moved by the impeller is directed into the space between the inner casing and the second shaft. The fluid lubricates the second shaft and the bearings as it moves towards the open end of the inner casing.

Other features and advantages of the present invention will be apparent to those skilled in the art from a careful reading of the Detailed Description of a Preferred Embodiment presented below and accompanied by the drawings.

DETAILED DESCRIPTION OF A PREFERRED EMBODIMENT

Figure 1:
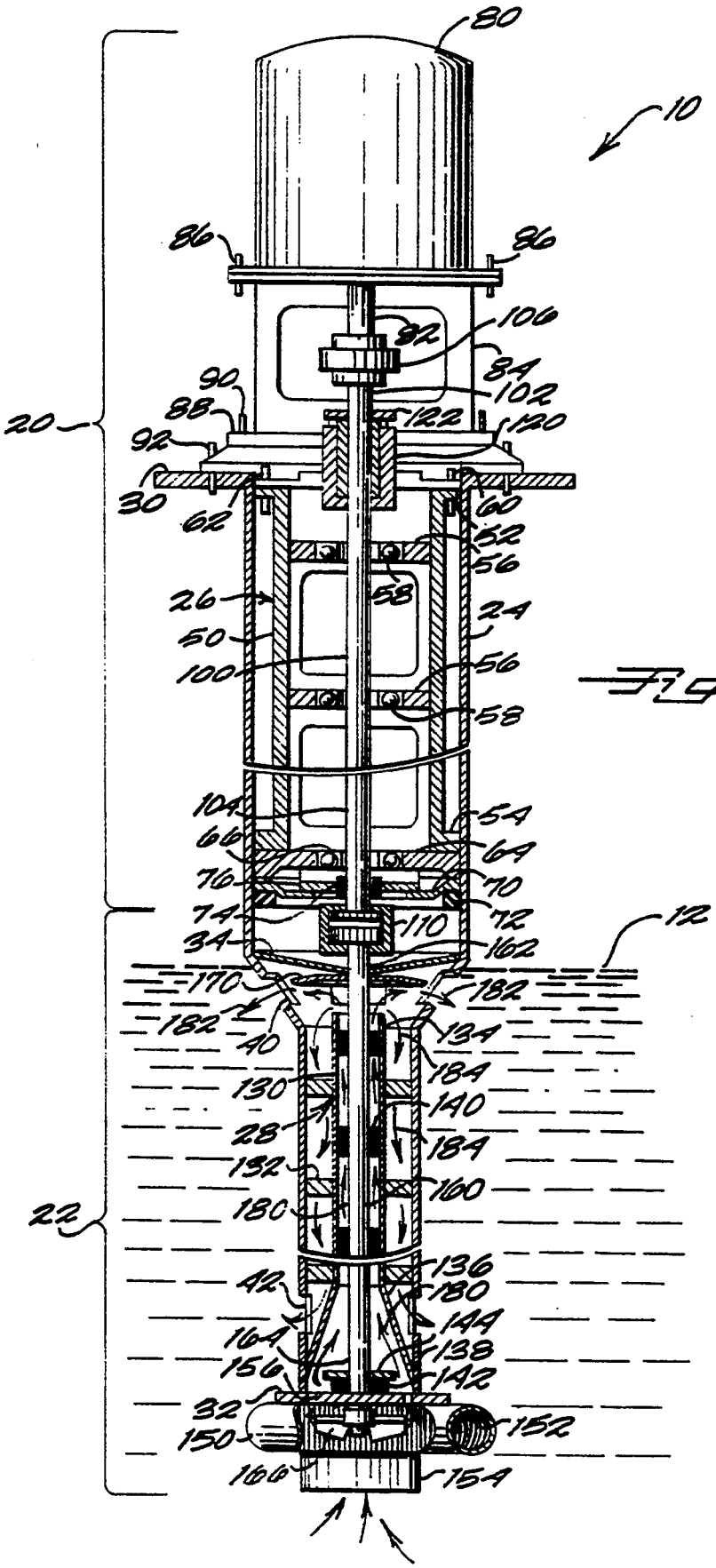
FIG. 1 is a cross-sectional view of an apparatus according to a preferred embodiment of the present invention.

Referring now to FIG. 1, there is shown a cross-sectional view of a pump 10 according to a preferred embodiment of the present invention. Pump 10 is supported relative to a holding tank (not shown) that contains a liquid 12. Pump 10 is adapted for pumping hazardous liquids, including especially toxic and radioactive liquids.

Pump 10 can be viewed as having a first portion 20 and a second portion 22. Both first and second portions 20, 22, are contained within an outer casing 24. First portion 20 includes a first assembly 26; second portion 22 includes a second assembly 28, as will be described below. Outer casing 24 has a flange 30 and a mounting plate 32, as shown in FIG. 1. A spray shield 34 separates first portion 20 from second portion 22. Outer casing 24 has openings 40 and 42 therethrough, as shown, and preferably a plurality of openings evenly spaced about the perimeter of casing 24.

First assembly 26 includes a drive cage assembly or support pedestal 50 having a first flange 52 and a second flange 54. Pedestal 50 carries a plurality of ball bearing retainers 56, each retainer 56 holding a plurality of ball bearings 58. First flange 52 is affixed to a ring flange 60 by any suitable means, such as bolts 62. Second flange 54 is affixed to a ball bearing retainer 64. Retainer 64 holds ball bearings 66. Preferably, retainer 64 may be integrally formed with second flange 54 if desired. Bearings 58 and 66 are any suitable type of lubricated bearing, as well known in the art.

A vapor barrier 70, a ring stop 72, a grease seal 74 and a retainer 76 are positioned against retainer 64. Ring stop 72 is preferably made of a flexible material such as rubber to conform to the surfaces of first portion 20 and to prevent gases, vapors, and so forth from second portion 22 from reaching first portion 20. If desired, some other type of vapor barrier may be used without departing from the spirit of the present invention.

A motor 80 having a motor driveshaft 82 is affixed to a motor bracket or support pedestal 84 by any suitable means, such as bolts 86. Pedestal 84 is fastened to a mounting plate 88 by bolts 90, or other fastening means. Mounting plate 88 is similarly fastened to flange 30 of casing 24 by bolts 92. Motor 80 is any type of motor adapted for use in the environment of pump 10. Thus, motor 80 may be an open motor, a motor contained within a leak-proof or corrosion-resistant housing, an explosion-proof motor, and so forth, meeting the requirements dictated by the environment of use. If desired, gaskets may be put between motor 80 and pedestal 84, between pedestal 84 and mounting plate 88, and between plate 88 and flange 30.

A first driveshaft 100 has a first end 102 and a second end 104. First end 102 is connected to motor driveshaft 82 by a coupling 106. Coupling 106 is any type of coupling that is capable of maintaining shaft 82 coaxial with shaft 100 and transmitting torque generated by motor 80 to shaft 100. By way of example, coupling 106 may include rigid flanges on each of shafts 82 and 100, fastened together to transmit torque to first driveshaft 100. Alternatively, coupling 106 may be a flexible coupling to reduce the effects of misalignment and torque variations. Shield 34 is deployed about shaft 100 adjacent to coupling 110, engaging casing 24, as seen in FIG. 1. Second end 104 of driveshaft 100 is rigidly connected to a blind slip coupling 110.

A retainer 120 extends through ring flange 60, mounting plate 88 and motor bracket 84, generally as indicated in FIG. 1. Retainer 120 carries a vapor seal 122 of any suitable type, preferably a packing gland such as is known in the art. Thus, driveshaft 100 extends from coupling 106 through vapor seal 122, bearings 58 and 66, and vapor seal 70 to coupling 110.

Second assembly 28 includes an inner casing 130, maintained in spaced relation to outer casing 24 by a plurality of retainers 132. Inner casing 130 has an open first end 134, and a sloping shoulder portion 136 terminating in an open second end 138. Second end 138 is attached to outer casing 24 by any suitable means.

Inner casing 130 carries a plurality of radial shaft bearings 140, preferably pumped fluid lubricated bearings. A thrust bearing 142 and a retainer 144 are positioned on mounting plate 32. Bearing 142 is any suitable type of shaft bearing, preferably a pumped fluid lubricated bearing, as known in the art.

An impeller casing or manifold 150 with an outlet 152 is attached to mounting plate 32. A strainer 154, preferably a suction strainer, is attached to casing 150. Mounting plate 32 has a plurality of openings 156 formed therethrough for circulation of fluid 12.

A second driveshaft 160 has a first end 162 and a second end 164. First end 162 extends through spray shield 34 and is rigidly coupled to slip coupling 110 by any suitable means. Coupling 110 transmits torque and maintains shafts 100 and 160 in alignment with each other, with shaft 100 coaxial with shaft 160, as coupling 106 similarly transmits torque and maintains shaft 100 (and therefore shaft 160) in alignment with motor shaft 82. Second end 164 carries an impeller 166, of any suitable design. Thus, shaft 160 extends from coupling 110 through spray shield 34, bearings 140 and 142, and mounting plate 32 to impeller 166.

A shaft slinger 170 is positioned at first end 162 of shaft 160, adjacent to spray shield 34. Slinger 170 is adapted to pick up fluid moving upwards along shaft 160 and direct the fluid outwardly toward casing 24 through openings 40. Slinger 170, together with spray shield 34, helps keep liquids from passing from second portion 22 into first portion 20 of pump 10.

Pedestals 50 and 84 are preferably of an open construction for ready access to first shaft 100, vapor seal 122, bearings 58, and the other parts of first assembly 26. Pump 10 may be of any suitable length for the desired application, up to approximately 40 ft. (about 12 m) in length. Pump 10 is made of any durable material suitable for use in the intended environment, preferably a material that has a long operating life and is easily decontaminated to minimize personnel exposure. For example, bearings 140, 142 and other high wear parts in second assembly 22 may be fabricated of highly durable steel alloys, such as STELLITE, or tungsten carbide, or similar hard, long-wearing materials.

In use, pump 10 is mounted so that only a portion of casing 24 is immersed in the fluid to be pumped, preferably with the fluid level no higher than approximately the level of spray shield 34. As motor 80 turns shaft 82, the rotation of shaft 82 is transferred to first shaft 100 by coupling 106 and to second shaft 160 by coupling 110. Impeller 166 pulls fluid 12 through suction strainer 154 into manifold 150. A portion of the fluid is directed towards outlet 152. Another portion of the fluid, indicated by arrows 180, is directed into the space between inner casing 130 and second shaft 160. The fluid moves between casing 130 and shaft 160 until it exits casing 130 at first end 134, lubricating bearings 140 and 142. A portion of the fluid, indicated by arrows 182, reaches slinger 170 and is flung outwards, exiting casing 24 through openings 40. Some fluid moves into the region between outer casing 24 and inner casing 130, exiting casing 24 through openings 42, as indicated by arrows 184.

Once pump 10 is installed, it may remain in position indefinitely with first portion 20 isolated from fluid 12 and all or part of second portion 22 immersed in the fluid. First assembly 26 can be easily removed from casing 24 for repairs or routine maintenance. First assembly 26 can be separated from second assembly 28 simply by releasing coupling 110, removing bolts 92 and lifting assembly 26 out of casing 24.

Coupling 110, with barrier 70 adjacent to one side of coupling 110 and shield 34 adjacent to the other side, effectively isolates first assembly 26 from second assembly 28. Shield 34 substantially prevents the fluid being pumped from contacting the parts of first assembly 26, that is, driveshaft 100, coupling 110, barrier 70, and so forth. Barrier 70 and seal 74 prevent gases and vapors from second portion 22 from entering first portion 20. Thus, shield 34 and barrier 70 isolate first assembly 26 from contamination by any hazardous constituents of fluid 12.

First assembly 26—the portion of pump 10 most likely to require maintenance—uses sealed grease bearings (bearings 58, 66). Second assembly 28 is self-lubricating, that is, the fluid being pumped serves to lubricate the high maintenance sections of assembly 28, such as bearings 140 and 142. Only second assembly 28 comes into contact with fluid Since first assembly 26 can be separated from second assembly 28 for carrying out repairs and maintenance, the risk of personnel exposure to hazardous constituents of the fluid is greatly reduced. This allows pump 10 to be serviced with greatly reduced personnel exposure and reduced decontamination requirements.

It will be apparent to those skilled in the an that many changes and substitutions can be made to the preferred embodiment herein described without departing from the spirit and scope of the present invention as defined by the appended claims.

What is claimed is:

1. An apparatus for use in pumping a hazardous fluid, said apparatus for use with a motor having a motor shaft, said apparatus comprising:

a casing;

a first driveshaft having a first end and a second end, said second end positioned within said casing;

means in said casing for supporting said first driveshaft in spaced relation to said casing;

a second driveshaft within said casing, said second driveshaft having a first end and a second end;

means in said casing for supporting said second driveshaft in spaced relation to said casing;

an impeller rotatably carried by said second driveshaft and in fluid communication with said hazardous fluid; and means the releasably connecting said first end of said second driveshaft to said second end of said first driveshaft, said connecting means holding said second driveshaft coaxially with said first driveshaft, so that, when said first end of said first driveshaft is connected to said motor shaft and said casing is partially immersed in said hazardous fluid, said impeller can pump said fluid when said second driveshaft rotates.

2. The apparatus as recited in claim 1, further comprising means for isolating said first driveshaft from said hazardous fluid.

3. The apparatus as recited in claim 1, further comprising a shield deployed about said first end of said second driveshaft proximate to said connecting means, said shield engaging said casing, said shield shielding said first driveshaft from said hazardous fluid.

4. The apparatus as recited in claim 1, wherein said apparatus has a first portion and a second portion, said first portion containing said first driveshaft, said second portion containing said connecting means and said second driveshaft, further comprising a barrier deployed about said second end of said first driveshaft proximate to said connecting means, said barrier engaging said casing, said barrier preventing gases and vapors from said second portion from entering said first portion.

5. The apparatus as recited in claim 1, wherein said apparatus has a first portion and a second portion, said first portion containing said first driveshaft, said second portion containing said connecting means and said second driveshaft, further comprising:

a shield deployed about said first end of said second driveshaft adjacent to said connecting means, said shield engaging said casing, said shield isolating said first portion from said hazardous fluid; and a barrier deployed about said second end of said first driveshaft adjacent to said connecting means, said barrier engaging said casing, said barrier preventing gases and vapors from said hazardous fluid from entering said first portion.

6. The apparatus as recited in claim 1, wherein said connecting means further comprises a blind slip coupling.

7. The apparatus as recited in claim 1, wherein said casing has a first portion and a second portion, and wherein said first supporting means further comprises:

a support in said first portion of said casing; and at least one bearing assembly carried by said support and engaging said first driveshaft, said support slidably received in said first portion of said casing so that said support and said first driveshaft are removable from said casing.

8. The apparatus as recited in claim 1, wherein said second supporting means further comprises means for directing said fluid between said second driveshaft and said casing to lubricate said second driveshaft with said fluid.

9. The apparatus as recited in claim 1, further comprising means for rotating said first driveshaft, said rotating means operatively connected to said first end of said first driveshaft.

10. A pump for pumping a hazardous fluid, comprising:

an outer casing having a first end and a second end;

a motor having a rotatable motor shaft operatively connected to said first end of said outer casing;

a first driveshaft extending into said outer casing, said first driveshaft having a first end and a second end, said first end of said first driveshaft connected to said motor shaft;

first supporting means in said outer casing for supporting said first driveshaft in spaced relation to said outer casing, said outer casing having at least one opening formed therethrough;

a second driveshaft within said outer casing, said second driveshaft having a first end and a second end;

second supporting means in said outer casing for supporting said second driveshaft in spaced relation to said outer casing, said second supporting means including an inner casing within said outer casing, said inner casing having a first end and a second end, said inner casing in spaced relation to said outer casing, said second end of said inner casing attached to said second end of said outer casing, at least one bearing assembly carried by said inner casing and rotatably supporting said second driveshaft in spaced relation to said inner casing, said impeller moving at least a portion of said hazardous fluid into said inner casing so that said portion exits said first end of said inner casing, and means carried by said second driveshaft for directing said exiting fluid towards said at least one opening so that said fluid exits said outer casing through said at least one opening;

means for releasably connecting said first end of said second driveshaft to said second end of said first driveshaft, said connecting means holding said second driveshaft coaxially with said first driveshaft;

an impeller attached to said second end of said second driveshaft, said impeller adapted for pumping said hazardous fluid when said apparatus is in said hazardous fluid; and means for isolating said first driveshaft from said hazardous fluid.

11. The apparatus as recited in claim 10, further comprising a shield deployed about said first end of said second driveshaft, said shield engaging said outer casing, said shield isolating said first driveshaft from said hazardous fluid.

12. The apparatus as recited in claim 10, wherein said apparatus has a first portion and a second portion, said first portion containing said first driveshaft, said second portion containing said connecting means and said second driveshaft, further comprising a barrier deployed about said second end of said first driveshaft, said barrier engaging said outer casing and preventing gases and vapors from said hazardous fluid from entering said first portion.

13. The apparatus as recited in claim 10, wherein said apparatus has a first portion and a second portion, said first portion containing said first driveshaft, said second portion containing said connecting means and said second driveshaft, said connecting means having a first side and a second, opposing side, said apparatus further comprising:

a shield deployed about said first end of said second driveshaft on said first side of said connecting means, said shield engaging said outer casing, said shield isolating said first portion from said hazardous fluid; and a barrier deployed about said second end of said first driveshaft on said second side of said connecting means, said barrier engaging said outer casing, said barrier preventing gases and vapors from said second portion from entering said first portion.

14. The apparatus as recited in claim 10, wherein said connecting means further comprises a blind slip coupling.

15. The apparatus as recited in claim 10, wherein said first supporting means further comprises:

a support in said outer casing, said support in spaced relation to said outer casing; and at least one bearing assembly carried by said support, said at least one bearing assembly rotatably supporting said first shaft.

16. The apparatus as recited in claim 10, wherein said directing means further comprises a slinger carried by said second driveshaft, said slinger directing fluid moving along said second driveshaft towards said at least one opening so that at least a portion of said fluid exits said outer casing through said at least one opening.

17. The apparatus as recited in claim 10, further comprising a seal deployed about said first end of said first driveshaft, said seal preventing vapors from said hazardous fluid from exiting said outer casing.

18. A method for making a pump for pumping a hazardous fluid, said pump having a first portion isolated from said fluid and a second portion not isolated from said fluid, said method comprising the steps of:

connecting a first driveshaft to a second driveshaft by a releasable coupling to form a coupled driveshaft, said releasable coupling aligning said first driveshaft coaxially with said second driveshaft;

covering said coupled driveshaft in a casing having a first portion and a second portion, said coupled driveshaft positioned in spaced relation to said casing so that said first driveshaft is in said first portion and said second driveshaft is in said second portion;

isolating said first portion from said second portion of said casing with a barrier, said barrier engaging said casing adjacent to said coupling, said barrier deployed about said first driveshaft to prevent gases and vapors from said hazardous fluid from entering said first portion;

placing a shield in said casing, said shield engaging said casing adjacent to said coupling, said shield deployed about said second driveshaft to prevent fluid from said second portion from entering said first portion;

attaching a motor to said first portion of said casing, said motor having a motor shaft;

connecting said first driveshaft to said motor shaft; and attaching an impeller to said second driveshaft.

19. The method as recited in claim 18, further comprising the steps of:

placing a support in said first portion of said casing, said support carrying at least one bearing assembly for rotatably supporting said first driveshaft, said support slidably received in said first portion of said casing so that said support and said first driveshaft are removable from said casing when said coupling is released; and inserting an inner casing into said second portion of said casing, said inner casing having a second end attached to a second end of said casing, said inner casing carrying at least one bearing assembly for rotatably supporting said second driveshaft in spaced relation to said inner casing.

20. The method as recited in claim 19, further comprising the steps of:

inserting an inner casing into said second portion of said casing, said inner casing having a first end and a second end, said second end attached to a second end of said casing, said inner casing carrying at least one bearing assembly for rotatably supporting said second driveshaft in spaced relation to said inner casing, said impeller moving at least a portion of said fluid into said inner casing so that said portion exits said first end of said inner casing;

forming at least one opening in said second portion of said casing; and attaching a slinger to said second driveshaft, said slinger directing fluid moving along said second shaft towards said at least one opening so that at least a portion of said fluid exits said casing through said at least one opening.

* * * * *